United States Patent [19]

Schneider

[11] 4,218,821

[45] Aug. 26, 1980

[54] TOOL HAVING PAIRED PIVOTED LEVER ARMS

[75] Inventor: Gerhard Schneider, Alta, Sweden

[73] Assignee: Mo och Domsjo Aktiebolag, Ornskoldsvik, Sweden

[21] Appl. No.: 919,891

[22] Filed: Jun. 28, 1978

[30] Foreign Application Priority Data

Jun. 29, 1977 [SE] Sweden ..... 7707550

[51] Int. Cl.[2] ..... B26B 13/28; B25B 7/06

[52] U.S. Cl. ..... 30/254; 76/104 A

[58] Field of Search ..... 30/254, 267; 76/104 A; 128/318, 321; 81/416; 29/526, 432

[56] References Cited

U.S. PATENT DOCUMENTS

| | | | |
|---|---|---|---|
| 1,886,271 | 11/1932 | Hoke | 30/267 X |
| 2,305,156 | 12/1942 | Grubel | 81/416 X |
| 3,828,515 | 8/1974 | Galgoczy | 29/526 |
| 4,099,315 | 7/1978 | Pudenz | 81/416 X |

FOREIGN PATENT DOCUMENTS

| | | | |
|---|---|---|---|
| 604813 | 5/1960 | Italy | 81/416 |

*Primary Examiner*—Jimmy C. Peters

[57] ABSTRACT

A tool of the nature of scissors, tongs, pliers or pincers is provided having a pair of lever arms pivotably attached together by a pivot pin, each having holder means at one end and tool-functional means at the other end on opposite sides of the pivot pin, for pivotable manipulative engaging movement of the tool-functional means by the holder means, comprising first and second lever arms, the first lever arm having a through slot receiving the second lever arm; the second lever arm having a central portion extending within the slot and a pivot pin immovably fixed to and extending through the central portion thereof and projecting outwardly on each side of the central portion; the projecting portions of the pivot pin defining pivot points for the pin; the pivot points of the pivot pin being cold-pressed into the walls of the first pivot arm within the slot, thereby defining in the walls cold-formed pivot sockets conforming in shape to the pivot point in a manner to pivotably mount the second lever arm on the first lever arm in the slot, for free pivoting movement with respect thereto guided and constrained by the walls of the slot.

A process is also provided for assembling such a tool, first inserting the second lever arm into the through slot of the first lever arm, and then cold-pressing the walls of the slot inwardly against the pivot points of the pivot pin so as to force the pivot points into the walls of the slot, and define the pivot sockets therein.

21 Claims, 7 Drawing Figures

TOOL HAVING PAIRED PIVOTED LEVER ARMS

Tools of the type of scissors, tongs, pliers and pincers have a pair of arms each of which has a holder means at one end and a tool-functioning means such as blades, jaws, or clamps at the other end, with a pivot mounting in between. The design which has one lever extending through a slot in the other, and mounted on a pivot pin therein, is preferred for many applications, because the walls of the slot guide and constrain the pivoting movement of the second arm on the first against rocking motion, reducing wear, and improving leverage.

The ends or pivot points of the pivot pin normally are either riveted in place on the first lever arm, or swaged, so as to lock the pin in place. When the pin is riveted or swaged, however, there is a considerable danger that the force in so doing will deform the central part of the pin, i.e., will throw it out of straight, to some extent, or crack the pin, or both, as a result of which the pivoting movement of the lever arms is impeded. Cracks may enlarge in use, and result in failure of the pivot joint.

During riveting or swaging, the structure of the metal of the pin may also be changed, so that during subsequent annealing and hardening processes the pin may become harder than the material from which the lever arms are made, with the result that the pivot point of the pin abrades the pivot socket in which it is mounted, and becomes loose, after which the lever arms cannot be manipulated properly for normal levering action or function as a tool.

When swaged or riveted pivot pins are used, it is important that the ends of the pin be ground smooth, so that they do not project beyond the surface of the first lever arm. However, it is not possible to do this at a low cost, and it is particularly expensive to smooth the surface of the pin ends so that they are free from grinding scratches and other surface defects of this type. Unless this is done, such imperfections in the surface become an entry point for corrosion, shortening the life of the tool.

In order to avoid deformation and cracking of the pivot pin during riveting or swaging, the ends of the pin have been welded in a box lock, reducing internal stresses and tensions in the pin. However, welding is just as unsuitable as riveting, since a change in the metal from which the pin is made and in the arm material surrounding the pin is obtained during welding. The resulting nonhomogeneity of the metal can lead to fracture of the pivot mounting.

To avoid these difficulties, a through bore can be provided in the lever arm carrying the pivot pin, and through which the pivot pin passes, with its ends extending outwardly from each surface of the arm a short distance. The slot in the other lever arm can then be heated until soft, and widened to the extent necessary to admit the pin, and the two lever arms will then be fixed in the correct position, relative to each other, after which the walls of the slot can be pressed against the pivot pin, which in this way is forced into the wall to provide a pivot socket. However, such intense heating of the metal in the slot region results in oxidation, which in turn gives way to corrosion. Moreover, since the pivot is being forced into the walls at an elevated temperature, and the walls shrink when cooled, there is a possibility that the pivot sockets after cooling will be too small, and the pivot points may only with difficulty move in the socket, if in fact they are movable at all.

The invention avoids these difficulties, first, by fixing the pivot pin immovably to and extending through a central portion of one lever arm, and second, by forcing the projecting pivot points of the pin by cold pressing into the walls of the other lever arm within the slot, the pivot points thereby cold-forming pivot sockets in the walls. The cold pressing is carried out at a temperature below that at which oxidation takes place, and preferably at room temperature.

The pivot sockets thus are formed in the cold, without oxidation, and at the temperature of use, so that there are no dimensional changes after formation. When the pin is immovably fixed in the lever arm so that it is not rotatable and not axially displaceable with respect thereto, the pin is able to take up very high axial forces while the walls of the slot are being pressed together upon the pivot points thereof, eliminating any possibility of deformation or cracking of the pin. Since the projecting ends of the pin are pressed into the metal of the slot walls while this material is cold, there will be no oxidation, and no change of dimensions on cooling. Any internal stresses present in the material as a result of the cold-pressing can be eliminated by annealing in a vacuum either the entire tool or just these portions of the lever arms thereof.

The hardness of the pivot pin must be greater than that of the metal of which the lever arms are made, so that the pin can absorb high pressures without deformation or cracks being formed therein in the course of cold-pressing the pivot points thereof into the slot walls.

Accordingly, the tool provided in accordance with the invention has a pair of lever arms pivotably attached together by a pivot pin, each having holder means at one end and tool-functional means at the other end on opposite sides of the pivot pin, for pivotable manipulative engaging movement of the tool-functional means by the holder means, comprising first and second lever arms, the first lever arm having a through slot receiving the second lever arm; the second lever arm having a central portion extending within the slot and a pivot pin immovably fixed to and extending through the central portion thereof and projecting outwardly on each side of the central portion; the projecting portions of the pivot pin defining pivot points for the pin; the pivot points of the pivot pin being cold-pressed into the walls of the first pivot arm within the slot, thereby defining in the walls cold-formed pivot sockets conforming in shape to the pivot points in a manner to pivotably mount the second lever arm on the first lever arm in the slot, for free pivoting movement with respect thereto guided and constrained by the walls of the slot.

A process is also provided for assembling such a tool, first inserting the second lever arm into the through slot of the first lever arm, and then cold pressing the walls of the slot together, so as to force the pivot points of the pivot pin into the walls of the slot, and define the pivot sockets therein.

A preferred embodiment of the invention is shown in the drawings, in which the tool is a pair of scissors or shears, in which.

Figure 1:
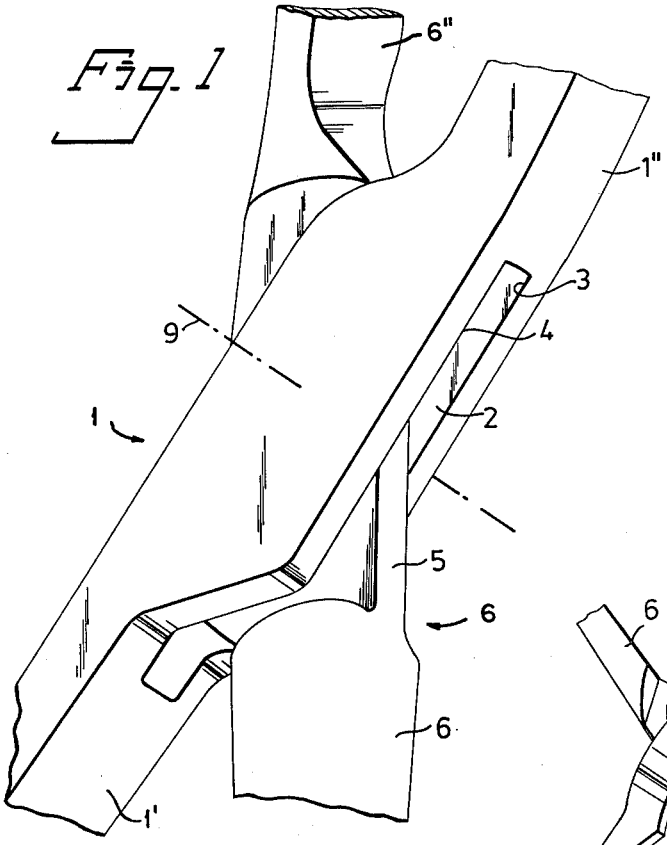
FIG. 1 shows the central portion of the scissors, at which portion the two lever arms of the scissors are pivotably attached together.
Figure 2:
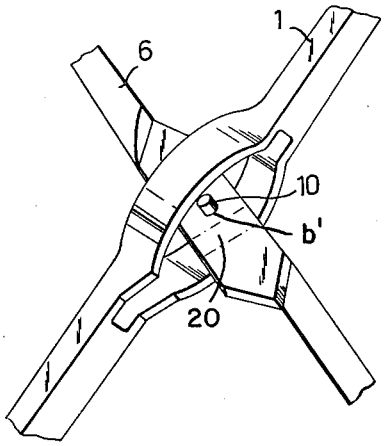
FIG. 2 shows the first lever arm of the scissors of FIG. 1, with the slot expanded so as to permit insertion of the second lever arm carrying the pivot pin prior to cold pressing, to pivotably attach the second lever arm to the first.

The scissors illustrated in FIGS. 1 to 4, which may also, for example, be a pair of tongs, a pair of pincers, an artery clamp, a pair of pliers, or a pair of shears, has a first lever arm 1 provided with a through slot 2 at a central portion thereof, the slot having parallel walls 3 and 4. Each lever arm 1,6 has a sharp blade portion 1',6', arranged facing each other on the same side of the pivot pin 10, and a holder portion 1'',6'', to be grasped in the hand, when manipulating the tool. In place of blades, clamps, grips, or noses can be provided.

The second lever arm 6 has a central flattened portion 5 which extends within the slot 2 in a reasonably snug fit, for guidance and constraint by the walls 3,4 thereof, but is still capable of free pivoting movement with respect to the first arm. Thus the two side surfaces 7 and 8 (best seen in FIG. 3) of the flattened portion 5 are planar or at least substantially planar and parallel, and coact with the planar parallel slot walls 3 and 4, during pivoting movement of the second lever arm therein.

The arm 6 carries an immovable pivot pin 10 whose pivot points 11,12 are held in pivot sockets 11',12' in such a manner as to permit pivoting of the lever arm 6 with respect to the lever arm 1.

The pivot pin 10 is pressed through and fixed in a bore 10' extending through the flattened portion 5 on the lever arm 6. The pin can be pressfitted in the bore, or fixed in place by welding, soldering or brazing, so that the pin is unable to rotate or be moved axially in the bore with respect to the lever arm 6, as a result of which the axial forces on the pin are taken up by the walls of the hole, so that the pin 10 will not be bent while the slot walls are being cold-pressed onto the pivot points 11, 12 on the end of the pin.

The pivot points 11,12 of the pivot pin each project on outwardly a distance of 0.5 mm from the flattened portion 5, the total length of the pin being 5 mm. The relative dimensions of the pin and the projecting portions depend on the size and type of tool, but in general the pivot points of the pin do not project more than 50% of the total length of the pin on each side of the lever arm 6.

Figure 3:
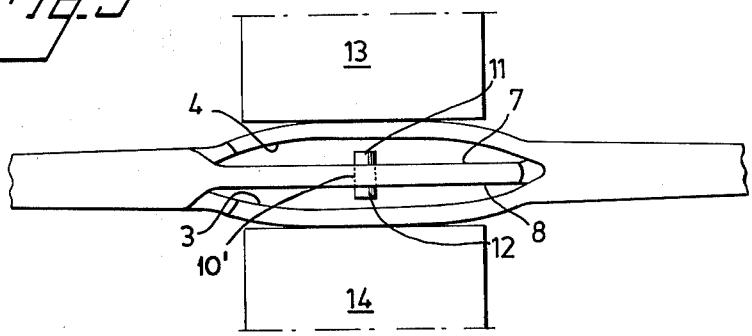
FIG. 3 shows the partially assembled tool of FIG. 2 in a cold press, for forcing the pivot point of the pivot pin into the slot walls of the first lever arm.
Figure 4:
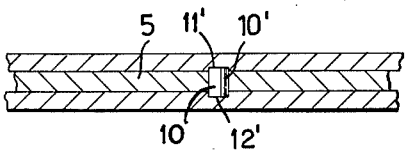
FIG. 4 shows the tool of the invention after the cold pressing operation shown in FIG. 3 has been completed, with the pivot points of the pivot pin defining pivot sockets in the slot walls.

In order to insert the second lever arm 6 in the first one, the walls of the slot are spread apart in the manner shown in FIG. 3. The lever arm 6 with the pivot pin 10 attached is then inserted in the slot, and the assembly placed in a cold press, such as is illustrated in FIG. 3. The pin 10 is aligned relative to the walls 3,4 of the slot in such a manner that the pivot axis of the pin coincides with the axis 9 shown in FIG. 1. The walls of the slot 3,4 are then pressed together by the pressing platens or heads 13,14 against the pivot point ends 11,12 of the pin, with the surfaces 4, 7 and 3, 8, respectively, being brought almost into contact with each other, with a spacing of from 0.1 to 0.01 mm therebetween.

The amount of pressure applied is controlled by the means for operating the platens 13,14, moving them towards and away from the slot portion of the lever arm 1, so that the slot is compressed in the bite between the heads. Sufficient pressure is applied to bring the walls 3,4 almost into contact with the walls 7,8 of the second lever arm 6, with the result that the projecting ends 11,12 of the pin 10 will be forced into the slot walls to a depth corresponding to the length of the projections that are the pivot points. At the same time, the pivot sockets formed by this cold deformation will correspond exactly to the shape of the projecting pivot points, giving good pivot sockets within which the pivot arm 6 can pivot freely without difficulty.

Figure 5:
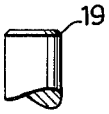
FIG. 5 shows on an enlarged scale one end of a preferred embodiment of pivot pin.

Preferably, the pin 10 is of a circular, cylindrical configuration, and the pivot points comprise end surfaces of the pin that extend perpendicularly to the axis of the cylinder with the edges 19, shown in FIG. 5, that are gently rounded. In the case of a pin having a diameter of 3 mm, the radius of the end edge may, for example, be from 0.2 to 0.4 mm.

Figure 6:
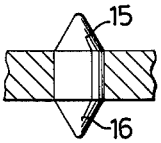
FIG. 6 shows on an enlarged scale another type of pivot pin in accordance wih the invention, immovably fixed in the second lever arm.

The pivot points of the pivot pin also can have the form of straight cones 15,16, as shown in FIG. 6.

While the central portion of the pin 10 which extends through a bore 10' through the lever arm 6 preferably should be cylindrical, it can be any polygonal or asymmetric shape, to fix it against rotation in the bore 10', such as square, elliptical, hexagonal, and triangular, and other irregular shapes. The pin 10 will be subjected to high compression forces when the walls of the slot are pressed together, but since the pivot points 11,12 have a relatively small height, and since the central part of the pin is firmly held by the walls of the bore 10', there is no risk of the pin's bending or being deformed in any way, or cracked.

Tests have shown that a tensile force of more than 500 kp acting perpendicularly on pivot points having a penetration depth of 0.5 mm into the walls of the slot is required to destroy the pivot pin. In contrast, a ball pivot can destroy the lever arm into which it is being forced when a load of some 10 kp is applied.

Subsequent to assembly, the tool is annealed at an elevated temperature, and in vacuum, as in a vacuum furnace, to remove internal stresses, and is subsequently hardened so that those parts which pivot or slide against each other have substantially the same hardness. The pin 10, which is initially very hard, can readily be softened, since the material is not subjected to such working as to cause a change in the structure. Thus, the pivot points 11,12 will have substantially the same hardness as the slot pivot sockets in the slot walls 3,4 thereby matching the wear and preventing uneven wear.

A tool having a riveted or welded pivot pin, or a tool having a pressed pivot pin of the conventional type, can be adjusted only with great difficulty if the lever arms move stiffly or with difficulty, and adjustment is practically impossible if the pivotable arm moves too freely.

The invention accordingly provides an embodiment which permits some adjustment of the degree of freedom of the pivoting movement of the pivoted lever arm with respect to the other. This is accomplished in the structure shown in FIG. 7 by providing both recesses and projecting portions on the surface of the flattened central portion of the second lever arm adjacent to the pivot pin and within the slot in which the lever arm and pivot pin are mounted. Either both or only one of the lever arm's surfaces can have such recesses and projecting portions. The depth of the recesses and the height of the extending portions are each small, and only of the order of a few micrometers. The recesses and projecting portions can be made by grinding down the surface to form recesses 17 with respect to which the non-ground surface becomes projecting portions 18 over an area adjacent the pivot pin 10, as illustrated by the area 20, defined by dashed lines, in FIG. 2. The recesses 17' and raised portion 18' lie within another area 20', on the opposite side of the pivot pin 10 corresponding to the area 20. The two areas lie symmetrically about the central axis of the pin 10. Two additional such areas in the remaining two quadrants about the pin 10 can be provided.

If friction at the pivot mountings 11,12 between the arms 1 and 6 is too high, external pressure is applied to the first lever arm 1 that extend over the recesses 17,17' of the lever arm 6 that are furthest away from the pin 10, with the result that the surface of the lever arm 1 will be slightly depressed over the recesses 17,17' and raised over the raised portions 18,18', with the result that the region carrying the pivot sockets 11',12' engaging the pivot points 11,12 of the pin 10 will be raised away from the pin slightly, thereby reducing the friction.

If the lever arm 6 moves too freely, because it is loose in the pivot sockets 11',12', pressure is applied to the lever arm 1 in the region between the pin 10 and the raised portions 18,18', with the result that the pivot sockets are pressed more tightly against the pivot points. Optionally, the pressure can be applied directly over the raised portions 18,18', so as to deform the same, in a manner to increase the area of the friction surfaces.

Figure 7:
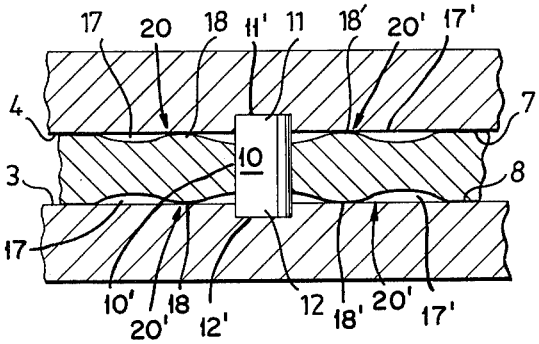
FIG. 7 is an enlarged view of an embodiment of the tool of the invention with the pivot pin mounted on a lever arm having a specially undulating surface, for reasons explained later in connection with the detailed description of this Figure.

It is also possible to form shallow recesses in the surfaces 7,8 of the lever arm 1, corresponding to the recesses 17,17' in arm 6, illustrated in FIG. 7, the regions between these grooves forming raised portions corresponding to portions 18,18'. Such recesses are curved as seen in the longitudinal direction of the lever arm 6, as are the recesses 17,17' illustrated in FIG. 7, so that when applying force against the raised portions 18,18' on both sides of the pin, the pivot sockets are flattened, with uniform downwardly sloping side portions.

Having regard to the foregoing disclosure, the following is claimed as the inventive and patentable embodiments thereof:

1. A tool having a pair of lever arms pivotably attached together by a pivot pin, each lever arm having holder means at one end and tool-functional means at the other end on opposite sides of the pivot pin, for pivotable manipulative engaging movement of the tool-functional means by the holder means, comprising first and second metallic lever arms; the first lever arm having a through slot receiving the second lever arm; the second lever arm having a central portion extending within the slot and a pivot pin immovably fixed to and extending through the central portion thereof and projecting outwardly on each side of the central portion; the pivot pin being of metal and having a hardness greater than that of the metal of which the lever arms are made; the projecting portions of the pivot pin defining pivot points for the pin; the pivot points of the pivot pin being cold-pressed into the walls of the first lever arm within the slot, thereby defining in the walls cold-formed pivot sockets conforming in shape to the pivot points in a manner to pivotably mount the second lever arm on the first lever arm in the slot, for free pivoting movement with respect thereto, guided and constrained by the walls of the slot.

2. A tool according to claim 1 in which each lever arm comprises a blade, and the tool is a scissors.

3. A tool according to claim 1 in which each lever arm comprises a clamp, and the tool is a pincers or tongs.

4. A tool according to claim 1 in which each lever arm comprises a gripping means, and the tool is a pliers.

5. A tool, according to claim 1 in which the through slot has parallel walls and the second lever arm has a flattened central portion fitting closely but freely pivotable within the slot.

6. A tool according to claim 1 in which the pivot pin is cylindrical with conical pivot points and extends through a bore in which it is fixed through the central portion of the second lever arm.

7. A tool according to claim 1 in which the pivot pin is cylindrical with rounded flat-faced pivot points and extends through a bore in which it is fixed through the central portion of the second lever arm.

8. A tool according to claim 1 in which the pivot pin projecting portions are no longer than half the total length of the pin.

9. A tool according to claim 1 in which the central portion of the second lever arm comprises on each of two sides of the pivot pin at least two recesses arranged radially adjacent to but spaced from the pivot pin and extending across the width of the central portion.

10. A tool according to claim 1 in which the slot walls of the first lever arm comprise on each of two sides of the pivot pin at least two recesses arranged radially adjacent to but spaced from the pivot pin and extending across the width of the slot walls.

11. A method of manufacturing a tool having a pair of lever arms pivotably attached together by a pivot pin, each lever arm having holder means at one end and tool-functional means at the other end on opposite sides of the pivot pin, for pivotable manipulative engaging movement of the tool-functional means by the holder means, comprising first and second metallic lever arms; the first lever arm having a through slot receiving the second lever arm; the second lever arm having a central portion extending within the slot; and a pivot pin immovably fixed to and extending through the central portion thereof and projecting outwardly on each side of the central portion; the pivot pin being of metal and having a hardness greater than that of the metal of which the lever arms are made; the projecting portions of the pivot pin defining pivot points for the pin; which comprises moving the walls of the slot outwardly a sufficient distance to permit insertion of the central portion and pivot pin of the second lever arm in the slot; inserting the central portion and pivot pin of the second lever arm in the slot; and cold-pressing the slot walls of the first lever arm against the pivot points of the pivot pin, and thereby cold-forming pivot sockets in the walls conforming in shape to the pivot points and pivotably mounting the second lever arm on the first lever arm in the slot for free pivoting movement with respect thereto, guided and constrained by the walls of the slot.

12. A process according to claim 11 in which each lever arm comprises a blade, and the tool is a scissors.

13. A process according to claim 11 in which each lever arm comprises a clamp, and the tool is a pincers or tongs.

14. A process according to claim 11 in which each lever arm comprises a gripping means, and the tool is a pliers.

15. A process according to claim 11 in which the through slot has parallel walls and the second lever arm has a flattened central portion fitting closely but freely pivotable within the slot.

16. A process according to claim 11 in which the pivot pin is cylindrical with conical pivot points and extends through a bore in which it is fixed through the central portion of the second lever arm.

17. A process according to claim 11 in which the pivot pin is cylindrical with rounded flat-faced pivot points and extends through a bore in which it is fixed through the central portion of the second lever arm.

18. A process according to claim 11 in which the pivot pin projecting portions are no longer than half the total length of the pin.

19. A process according to claim 11 in which the central portion of the second lever arm comprises on each of two sides of the pivot pin at least two recesses arranged radially adjacent to but spaced from the pivot pin and extending across the width of the central portion, and the first lever arm is deformed in a region extending adjacent the recesses to adjust the fit of the pivot mounting.

20. A process according to claim 11 in which the slot walls of the first lever arm comprise on each of two sides of the pivot pin at least two recesses arranged radially adjacent to but spaced from the pivot pin and extending across the width of the slot walls, and the first lever arm is deformed in a region extending adjacent the recesses to adjust the fit of the pivot mounting.

21. A process according to claim 11, which comprises heating at least the pivot mounting and adjacent parts of the tool in a vacuum to anneal the tool.

* * * * *